US006003491A

United States Patent [19]

Kawasaki

[11] Patent Number: 6,003,491

[45] Date of Patent: Dec. 21, 1999

[54] ENGINE FUEL INJECTION CONTROLLER

[75] Inventor: Takao Kawasaki, Yamato, Japan

[73] Assignee: Nissan Motor Co., Ltd., Kanagawa, Japan

[21] Appl. No.: 09/118,071

[22] Filed: Jul. 17, 1998

[30] Foreign Application Priority Data

Jul. 23, 1997 [JP] Japan ..... 9-196693

[51] Int. Cl.[6] ..... F02M 3/00

[52] U.S. Cl. ..... 123/339.17; 123/339.16

[58] Field of Search ..... 123/339.16, 339.17, 123/339.18, 680

[56] References Cited

U.S. PATENT DOCUMENTS

| | | | |
|---|---|---|---|
| 4,344,399 | 8/1982 | Matsumura et al. | 123/339.19 |
| 4,444,168 | 4/1984 | Matsumura et al. | 123/339.17 |
| 4,475,504 | 10/1984 | Mizuno | 123/339.17 |
| 5,081,973 | 1/1992 | Minamitani | 123/339.17 |
| 5,121,725 | 6/1992 | Araki | 123/339.17 |
| 5,875,757 | 3/1999 | Mizuno | 123/339.16 |
| 5,878,711 | 3/1999 | Kamura et al. | 123/339.16 |

FOREIGN PATENT DOCUMENTS 60-101243 6/1985 Japan .

*Primary Examiner*—John Kwon
*Attorney, Agent, or Firm*—McDermott, Will & Emery

[57] ABSTRACT

A basic fuel injection amount is calculated based on the intake air amount detected by an air flow meter, and the basic fuel injection amount is corrected based on a phase delay of an intake air amount variation between the engine and air flow meter so as to calculate a first correction injection amount. The first correction injection amount is corrected to a second correction injection amount based on an increase amount which is different according to whether or not the engine is in the idle running state. A fuel injector performs fuel injection based on this second correction injection amount. The increase amount is determined by multiplying a difference between the first correction injection amount and basic fuel injection amount, by a predetermined gain. Due to this, a shift of the air-fuel ratio to the lean side when a new load such as an air conditioner is exerted on the engine in the idle running state, is suppressed.

6 Claims, 3 Drawing Sheets

ENGINE FUEL INJECTION CONTROLLER

The contents of Tokugan Hei 9-196693, with a filing date of Jul. 23, 1997 in Japan, are hereby incorporated by reference.

FIELD OF THE INVENTION

This invention relates to air-fuel ratio control during idle running of an engine.

BACKGROUND OF THE INVENTION

In a vehicle engine, feedback control of a fuel-air ratio of air-fuel mixture aspirated into a combustion chamber based on oxygen density in the exhaust is disclosed for example in Tokkai Sho 60-101243 published by the Japanese Patent Office in 1985. Specifically, an injection amount of a fuel injector injecting fuel into an intake port of the engine is controlled based on the oxygen density in the exhaust. The fuel-air ratio is a reciprocal ($1/\lambda$) of the air-fuel ratio ($\lambda$).

However when the load of an auxiliary instrument such as an air conditioner acts on the engine during idle running (viz., idling), to maintain the engine rotating speed of an engine at a predetermined limit necessary to maintain stability of combustion, the fuel supply amount must be increased to increase the output torque of the engine.

Due to this control, the intake air amount and fuel amount aspirated by the engine increase together, but as air is a compressible fluid, increase of air inflow to the combustion chamber is relatively gradual compared to the increase in the opening of the intake throttle. On the other hand, as part of the fuel injected from the fuel injector adheres to the surface of the port wall, the fuel inflow amount to the combustion chamber of the engine increases slowly relative to increase of injection amount.

In a multi-cylinder engine immediately after torque increase control, fuel oversupply or undersupply may occur in cylinders depending on the combustion sequence, and the air-fuel ratio is apt to change between rich and lean. A rich shift of the air-fuel ratio acts to stabilize combustion if it is within a certain range, but a lean shift of the air-fuel ratio may make combustion unstable.

SUMMARY OF THE INVENTION

It is therefore an object of this invention to suppress fluctuation of an air-fuel ratio to lean when a new load is added to an engine during idle running.

In order to achieve the above objects, this invention provides a fuel injection controller for an engine comprising a fuel injector for injecting fuel into the intake air of an engine, a sensor for detecting an intake air amount of the engine, a sensor for detecting that the engine is in an idle running state, and a microprocessor for controlling the injector. The microprocessor is programmed to calculate a basic fuel injection amount based on the intake air amount, correct the basic fuel injection amount based on a phase delay of intake air between the intake air amount detection sensor and the engine so as to calculate a first correction injection amount, determine an increase amount in the idle running state which is different depending on whether or not the engine is in an idle running state, the increase amount when the engine is in the idle running state being calculated by multiplying a difference between the first correction injection amount and the basic fuel injection amount by a predetermined gain, correct the first correction injection amount to a second correction injection amount based on the increase amount and control the injector so that the injector performs fuel injection on the basis of the second correction injection amount.

It is preferable that the microprocessor is further programmed to limit the increase amount by a predetermined upper limit and lower limit.

It is further preferable that the microprocessor is further programmed to increase the upper limit and lower limit in direct proportion to the first corrected injection amount.

It is also preferable that the microprocessor is further programmed to set the increase amount to zero when the engine is not running in the idle running state.

If the engine comprises an intake port which introduces intake air into the engine and the fuel injector injects fuel into the intake port, it is preferable that the microprocessor is further programmed to estimate a fuel adhesion amount injected by the fuel injector into the intake port, and to add a correction amount based on the adhesion amount to the second correction injection amount so as to determine an injection amount of the fuel injector.

The details as well as other features and advantages of this invention are set forth in the remainder of the specification and are shown in the accompanying drawings.

DESCRIPTION OF THE PREFERRED EMBODIMENTS

Figure 1:
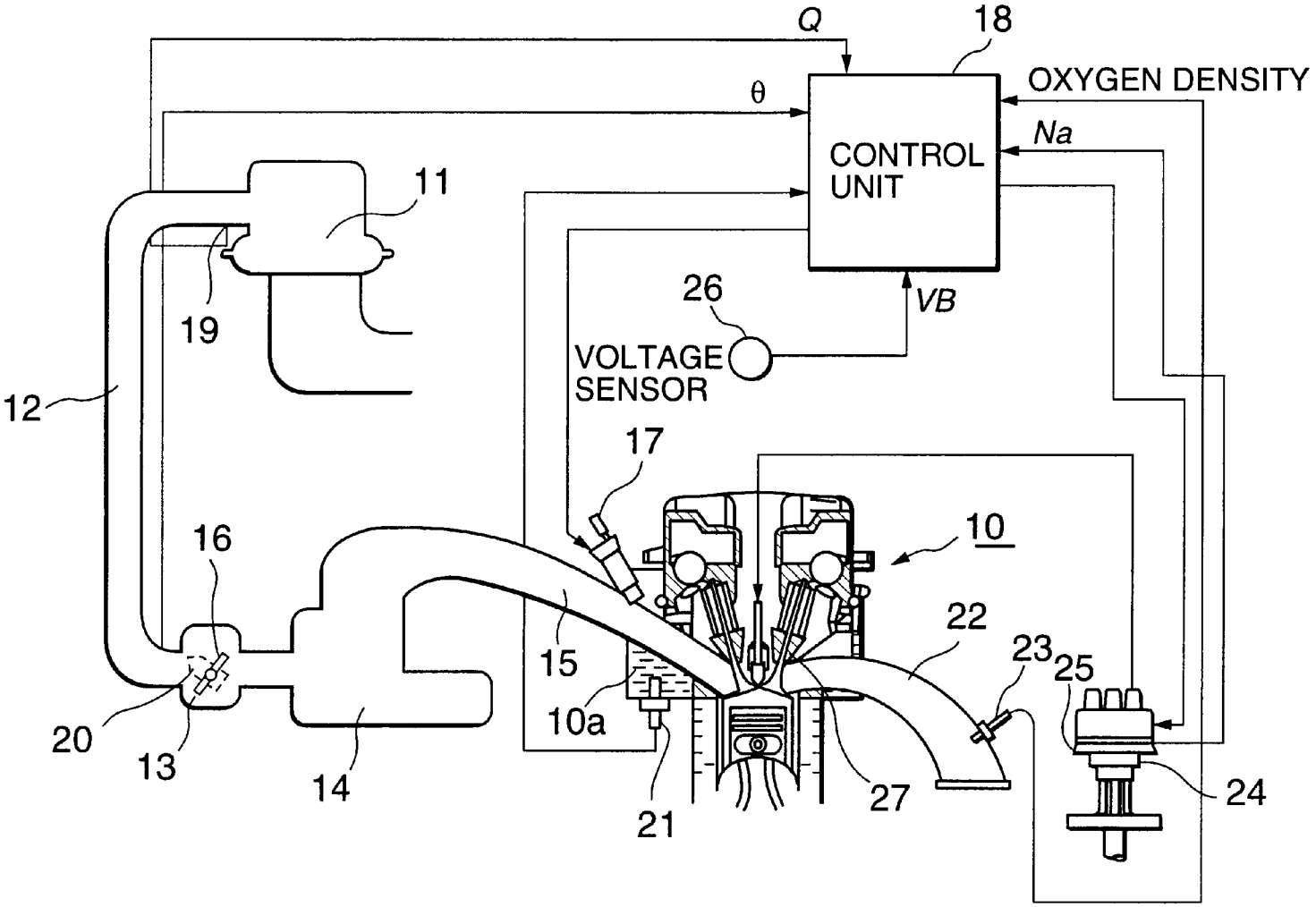
FIG. 1 is a schematic diagram of a fuel injection controller according to this invention.

Referring to FIG. 1 of the drawings, an engine 10 aspirates air via an air cleaner 11, air intake duct 12, throttle chamber 13, intake collector 14 and intake port 15. An intake air amount increases and decreases according to the opening of a throttle 16 provided in the throttle chamber 13. The opening of the throttle 16 varies according to depression of an accelerator pedal, not shown.

An electronically controlled fuel injector 17 injects fuel into the intake air of the intake port 15. A spark plug 27 arranged in the combustion chamber ignites the air-fuel mixture aspirated in the combustion chamber of the engine 10 according to an electric current from a distributor 24. The air-fuel mixture burns due to this ignition, and is discharged via an exhaust port 22 as combustion gas.

A fuel injection amount of the fuel injector 17 is controlled by a pulse signal output from a control unit 18. For this control, signals from an air flow meter 19 which detects an intake air amount Q, throttle sensor 20 which detects a throttle opening $\theta$, water temperature sensor 21 which detects a cooling water temperature Tw of the engine 10, $O_2$ sensor 23 which detects an oxygen density of the exhaust in the exhaust port 22, crank angle sensor 25 provided in a distributor 24 which detects a rotation speed Ne of the engine 10, and a voltage sensor 26 which detects a voltage VB of a battery, not shown, are input into the control unit 18.

Based on these signals, a fuel injection amount of the fuel injector 17 is calculated, and the control unit 18 outputs a corresponding pulse signal to the fuel injector 17.

A process of calculating this fuel injection amount performed by the control unit 10 will next be described.

Figure 2:
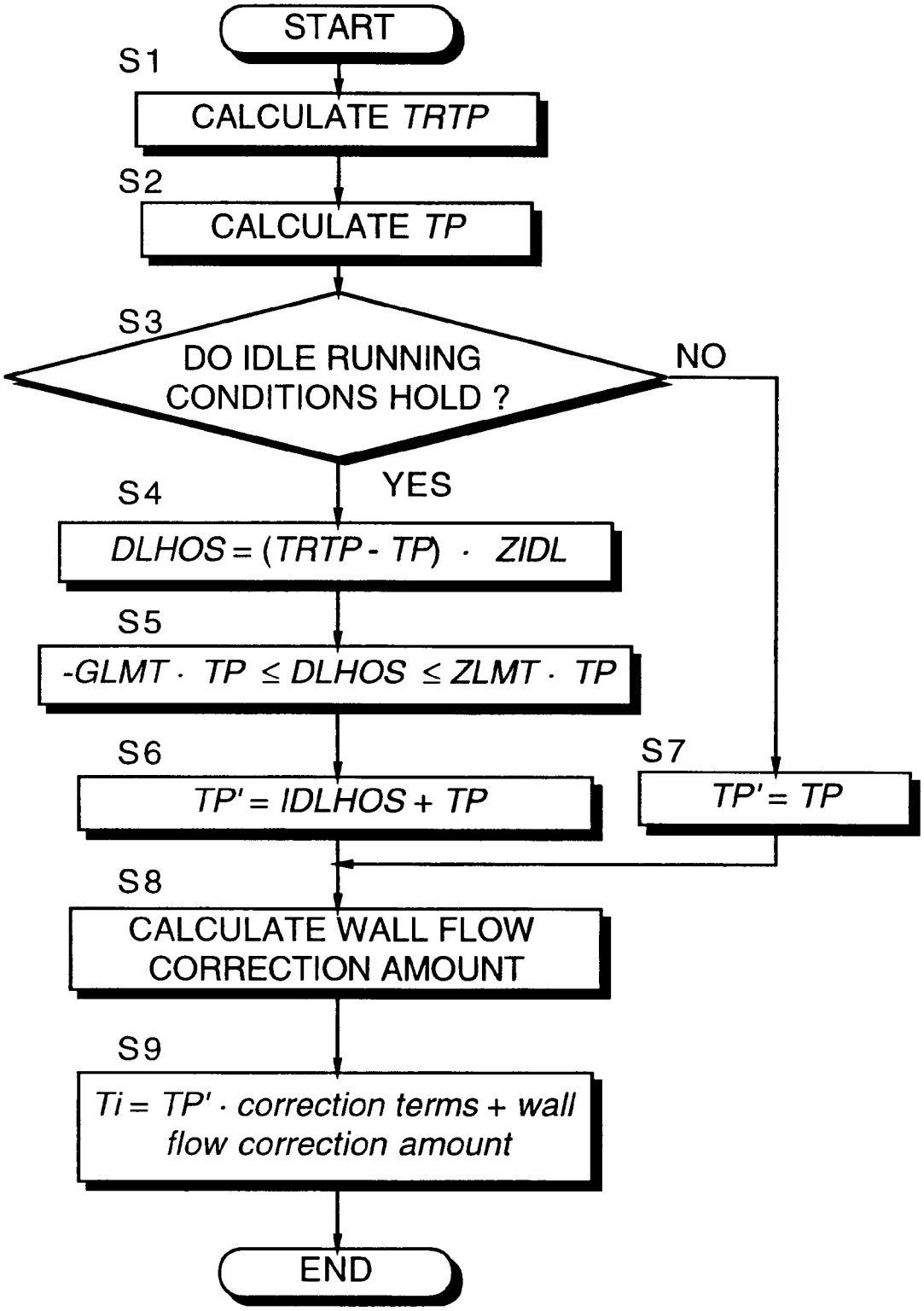
FIG. 2 is a flowchart describing a process of calculating a fuel injection amount during idle running performed by the fuel injection controller.

Referring to the flowchart of FIG. 2, first in a step S1, a basic injection fuel amount TRTP is calculated. The basic injection fuel amount TRTP is a function of the intake air amount Q and engine rotation speed Ne. This relation is stored beforehand in the control unit 10 in the form of a numerical formula or map. In the step S1, the basic injection fuel amount TRTP is calculated using the formula or a map from the intake air amount Q and engine rotation speed Ne.

In a step S2, a first correction injection amount TP taking account of a phase delay from when intake air leaves an air flow meter 19 to when it reaches the combustion chamber is calculated relative to the basic injection fuel amount TRIP.

In other words, a delay period occurs due to the capacity of the intake system and operating delay of the throttle 16 until a variation of intake air amount measured by the air flow meter 19 extends to the combustion chamber, and as the fuel injection amount follows a pulse signal with almost no delay, a deviation occurs between a real air-fuel ratio in the combustion chamber and a target air-fuel ratio when the intake air volume fluctuates. The quantity which corrects this deviation is the first correction injection amount TP.

In a step S3, it is determined whether or not idle running conditions hold based on the throttle opening θ. Specifically, when the throttle opening θ is equal to or less than a predetermined throttle opening, it is determined that idle running conditions hold.

In case of idle running conditions, the process proceeds to a step S4, and when idle running conditions do not hold, the process proceeds to a step S7.

In the step S4, an idle correction amount IDLHOS is calculated by the following equation (1) using the first correction injection amount TP.

$$IDLHOS=(TRTP-TP)\cdot ZIDL \quad (1)$$

where, ZIDL=gain

The value of the gain ZIDL is determined by experiment.

In a step S5, the idle correction amount IDLHOS is limited to a value in a predetermined range by the following equation (2). The objective of this limit in feedback control of air-fuel ratio is to prevent an excessive correction from being performed and ensure stability of combustion.

$$-GLMT\cdot TP \leqq DLHOS \leqq ZLMT\cdot TP \quad (2)$$

GLMT is a parameter for multiplying the first correction injection amount TP in order to limit the minimum value of the idle correction amount IDLHOS, and ZLMT is a parameter for multiplying the first correction injection amount TP in order to limit the maximum value of the idle correction amount IDL HOS. The values of these parameters are determined experimentally. As is clear from equation (2), the range of values that can be taken for the idle correction amount IDLHOS increases in direct proportion to the first correction injection amount TP.

In a step S6, a second correction injection amount TP' for idle running is calculated based on the idle correction amount IDLHOS and the first correction injection amount TP, by the following equation (3).

$$TP'=IDLHOS+TP \quad (3)$$

On the other hand, in the step S7, the second correction injection amount TP' is set equal to the first correction injection amount TP. In other words, the idle correction is not performed.

In a step S8, a wall flow correction is added relative to the second correction injection amount TP' which was determined in the step S6 or step S7. This is a correction that takes account of the part of the fuel injected into the intake port 5 from the fuel injector 17 which adheres to the surface of the wall of the intake port 5.

For this correction, the fuel amount adhering to the intake port 5 is estimated by referring to a preset map, based on a throttle opening variation rate dθ/dt obtained by differentiating the engine rotation speed Ne and throttle opening θ with respect to time. Such an estimation of adhesion fuel amount is known for example from U.S. Pat No. 5,265,581. A fuel injection amount Ti is then calculated by the following equation (4) in a step S9 with the estimated fuel adhesion amount as a wall flow correction amount.

$$Ti=TP'\cdot \text{correction terms}+\text{wall flow correction amount} \quad (4)$$

Herein, the correction terms comprise a fuel-air ratio correction coefficient and a fuel increase correction coefficient during warm-up. The fuel-air ratio correction coefficient sets the target fuel-air ratio to either lean or rich, and when the fuel-air ratio is equal to the stoichiometric air-fuel ratio, this coefficient is 1.0. By changing the fuel-air ratio correction coefficient to various values according to engine running conditions, the stability of the engine in a cold start is improved, output demand for heavy engine load is met, and lean burn can be performed.

The fuel increase correction coefficient during warm-up is a coefficient set based on the cooling water temperature Tw and engine rotation speed Ne, and its objective is to stabilize engine combustion by increasing the injection amount when the engine is being warmed up.

In addition, a voltage correction amount on the basis of the battery voltage VB may be added to the correction of equation (4). This is a correction amount to increase the injection amount according to a decrease of battery voltage VB and promote charging of the battery from a generator connected to the engine, and it is added in the same way as the wall flow correction amount.

Figure 3:
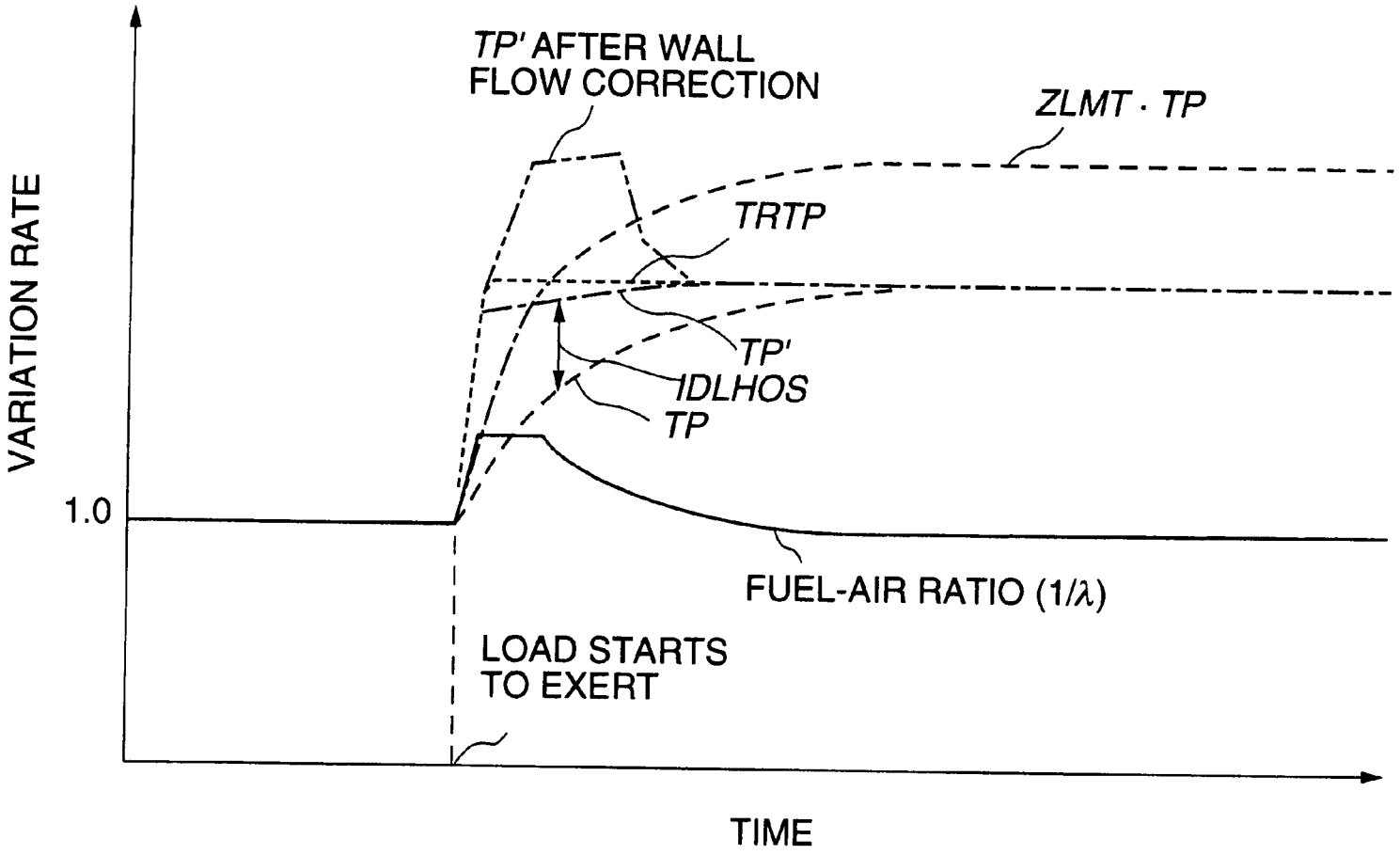
FIG. 3 is a timing chart describing a fuel injection amount during idle running and a variation of the air-fuel ratio due to the fuel injection controller.

When a new load is exerted on the engine during idle running as shown in FIG. 3, the first idle correction amount IDLHOS increases largely due to the above described fuel injection amount correction.

On the other hand, the first correction injection amount TP increases gradually when the load begins to act, and the upper limit ZLMT·TP of the idle correction amount IDLHOS increases together with the first correction injection amount TP. Therefore, immediately after the load starts to act, the upper limit ZLMT·TP is small, the idle correction amount IDLHOS is limited to the upper limit ZLMT·TP, and the value obtained by adding the upper limit ZLMT·TP to the first correction injection amount TP becomes the second correction injection amount TP'.

When the upper limit ZLMT * TP exceeds the idle correction amount IDLHOS calculated in the step S4, the value obtained by adding the idle correction amount IDLHOS calculated in the step S4 to the first correction injection amount TP subsequently becomes the second correction injection amount TP'.

As a result, the second correction injection amount TP' varies according to the dot-and-dash line in the figure. Due to this variation of the second correction injection amount TP', the fuel-air ratio (1/λ) increases rapidly immediately after the load starts to act, decreases gradually with time, and returns to its value before the load started acting.

Due to this variation of the air-fuel ratio, the engine, immediately after the load starts to act, is always driven with a rich air-fuel ratio and a lean shift of the air-fuel ratio does not occur. Therefore combustion in the engine combustion chamber is stabilized, and rotation fluctuation of the engine is suppressed.

The double dotted line of FIG. 3 shows the result of wall flow correction relative to the second correction injection amount TP'. Due to this correction, the fuel amount that is actually aspirated into the engine 10 immediately after the load begins to act becomes equal to the case when fuel does not adhere to the intake port 5.

In this example, an engine was described in which fuel was injected into an intake port, but the invention may be applied also to a direct injection type engine where fuel is injected directly into the combustion chamber.

The corresponding structures, materials, acts, and equivalents of all means plus function elements in the claims below are intended to include any structure, material, or acts for performing the functions in combination with other claimed elements as specifically claimed. The embodiments of this invention in which an exclusive property or privilege is claimed are defined as follows:

What is claimed:

1. A fuel injection controller for an engine including a combustion chamber, comprising:

a fuel injector for injecting fuel into intake air of an engine, a sensor for detecting an intake air amount of the engine, a sensor for detecting that said engine is idling, and a microprocessor programmed, in response to the detection of engine idling, to:

calculate a basic fuel injection amount based on the intake air amount, correct said basic fuel injection amount based on a phase delay of intake air between said intake air amount detection sensor and said combustion chamber so as to calculate a first correction injection amount, determine an increase amount for engine idling by multiplying a difference between said first correction injection amount and said basic fuel injection amount by a predetermined gain, correct said first correction injection amount to a second correction amount based on said increase amount, and control said injector during engine idling so that said injector performs fuel injection on the basis of said second correction injection amount.

2. A fuel injection controller as defined claim 1, wherein said microprocessor is further programmed to limit said increase amount by a predetermined upper limit and lower limit.

3. A fuel injection controller as defined in claim 2, wherein said microprocessor is further programmed to increase said upper limit and lower limit in direct proportion to said first corrected injection amount.

4. A fuel injection controller as defined in claim 1, wherein said microprocessor is further programmed to set said increase amount to zero when said engine is not idling.

5. A fuel injection controller for an engine including a combustion chamber, comprising:

a fuel injector for injecting fuel into intake air of an engine, a sensor for detecting an intake air amount of the engine, a sensor for detecting that said engine is idling, and a microprocessor programmed to:

calculate a basic fuel injection amount based on the intake air amount, correct said basic fuel injection amount based on a phase delay of intake air between said intake air amount detection sensor and said combustion chamber so as to calculate a first correction injection amount, determine an increases amount in the idle running state which is different depending on whether or not the engine is in an idle running state, said increase amount depending on whether or not the engine is the idle running state being calculated by multiplying a difference between said first correction injection amount and said basic fuel injection amount by a predetermined gain, correct said first correction injection amount to a second correction amount based on said increase amount and control said injector in an idle running state of said engine so that said injector performs fuel injection on the basis of said second correction injection amount, wherein said engine comprises an intake port which introduces intake air into said engine, said fuel injector injects fuel into said intake port, and said microprocessor is further programmed to estimate a fuel adhesion amount injected by said fuel injector into said intake port, and to add a correction amount so as to determine an injection amount of said fuel injector.

6. A fuel injection controller for an engine having a combustion chamber and an induction conduit leading to the combustion chamber, comprising:

means for injecting fuel into the intake air of the engine, means for detecting an intake air amount of the engine disposed in the induction conduit at a location upstream of the combustion chamber, means for detecting that said engine is idling, means for calculating a basic fuel injection amount based on the detected intake air amount, means for correcting said basic fuel injection amount based on a phase delay associated with the flow of intake air between said intake air amount detecting means and the combustion chamber of said engine and for calculating a first correction injection amount, means for calculating an increase amount for engine idling by multiplying a difference between said first correction injection amount and said basic fuel injection amount by a predetermined gain, means for correcting said first correction amount to a second correction amount based on said increased amount, and means for controlling said injector so that said injector injects fuel on the basis of said second correction amount.

* * * * *